United States Patent [19]

Emmons

[11] Patent Number: 4,482,332

[45] Date of Patent: Nov. 13, 1984

[54] ARRANGEMENT FOR MOUNTING AND STEERING AN OUTBOARD MOTOR

[76] Inventor: J. Bruce Emmons, 2213 Sand Lake Rd., Lindenhurst, Ill. 60046

[21] Appl. No.: 574,202

[22] Filed: Jan. 27, 1984

Related U.S. Application Data

[63] Continuation of Ser. No. 286,869, Jul. 27, 1981, abandoned.

[51] Int. Cl.[3] ..... B63H 25/42

[52] U.S. Cl. ..... 440/53; 114/144 R; 248/642; 248/900

[58] Field of Search ..... 248/640–643, 248/53, 55, 52, 57, 61, 62, 900; 440/49, 52, 53, 54, 65; 114/144 R, 162, 150, 165

[56] References Cited

U.S. PATENT DOCUMENTS

| | | | |
|---|---|---|---|
| 871,459 | 11/1907 | Thorsen | 248/643 |
| 2,714,362 | 8/1955 | Schroeder | 440/62 |
| 2,737,920 | 3/1956 | Heath | 440/61 |
| 3,033,500 | 5/1962 | Graves | 248/641 |
| 3,062,173 | 11/1962 | Kiekhaefer | 440/53 |
| 3,075,490 | 1/1963 | Lang | 248/642 |
| 3,107,073 | 10/1963 | Monroe | 248/642 |
| 3,404,656 | 10/1968 | Chamberlain | 440/57 |
| 3,613,631 | 10/1972 | Wick | 440/52 |
| 3,968,768 | 7/1976 | Solt | 440/62 |
| 4,302,195 | 11/1981 | Bryant | 248/640 |

FOREIGN PATENT DOCUMENTS

| | | | |
|---|---|---|---|
| 401515 | 8/1942 | Italy | 440/53 |

*Primary Examiner*—Trygve M. Blix
*Assistant Examiner*—Thomas J. Brahan
*Attorney, Agent, or Firm*—Wood, Herron & Evans

[57] ABSTRACT

An arrangement for steerably mounting an outboard motor on a boat in which the mounting is effected such that the steering axis of rotation of the motor is angled rearwardly so that the center of gravity of the motor lies at or forward of the axis. The outboard motor has a lower pivotal attachment point generally forward of the motor drive shaft and preferably above and/or forward of the hydraulic center of pressure on the lower motor gear case housing. The upper pivotal attachment of the outboard motor may be effected by a single pivot point generally rearward of the motor drive shaft or by the provision of a virtual pivot point to provide the desired angle for the axis of rotation. The virtual pivot point is obtained through the use of a linkage arrangement including a pair of links. The links are pivotally attached to the rear of the boat at their first ends and pivotally attached on opposite sides of the lower gear case housing at their other ends.

11 Claims, 5 Drawing Figures

ARRANGEMENT FOR MOUNTING AND STEERING AN OUTBOARD MOTOR

This application is a continuation of application Ser. No. 286,869, filed July 27, 1981 now abandoned.

DESCRIPTION OF THE INVENTION

This invention relates generally to mounting arrangements for an outboard motor on a boat and more particularly concerns such arrangements providing improved handling characteristics for the boat.

When large outboard motors are mounted to relatively small hulls, the speed and handling of the boat are frequently limited by a self-excited oscillatory instability commonly known as chine-walking or fishtailing. This instability can be reduced by designing the outboard motor so that the hydrodynamic center of pressure of the gear case is at or behind the steering axis. Such designs are not too difficult to achieve, and they are commonly used. Much of the remaining instability is attributable to the behavior of the mass of the outboard motor itself. Dealing with this source of instability is more difficult than dealing with instability introduced by improper location of the hydrodynamic center of pressure. Correction of the instability introduced by the outboard motor mass has not been satisfactorily accomplished in a production outboard motor mounting and steering arrangement.

It is consequently an object of the present invention to provide a mounting and steering arrangement for an outboard motor to enhance the speed and handling capabilities of a boat, and particularly to minimize the oscillatory instability known as chine-walking or fishtailing.

It is a more particular object of the invention to provide such a mounting and steering arrangement which significantly reduces oscillatory instability due to the mass of the outboard motor.

These objects of the invention are met by the outboard motor mounting and steering arrangements disclosed herein by the provision of an actual or virtual steering axis for the outboard motor oriented such that the center of mass of the motor lies at or in front of the axis. As disclosed, the benefits of proper positioning of the steering axis relative to the hydrodynamic center of pressure can also be more readily obtained.

Other objects and advantages of the invention will become apparent upon reading the following detailed description and upon reference to the drawings, in which.

Figure 1:
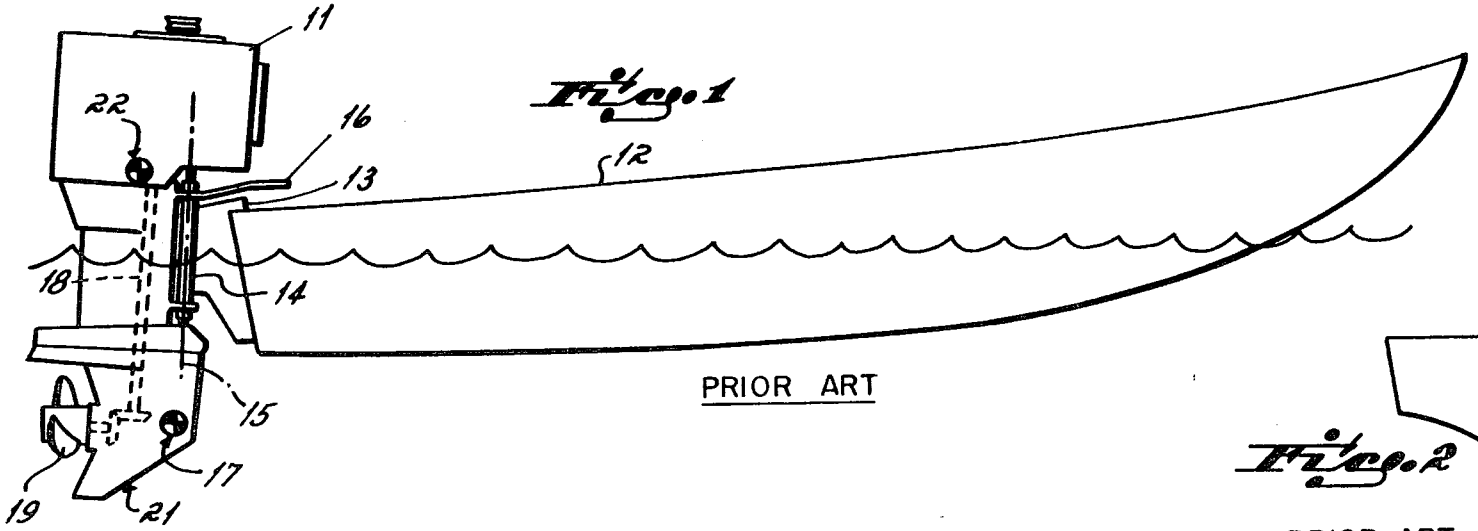
FIG. 1 is a side view of a conventional outboard motor, boat and boat mounting arrangement.
Figure 2:
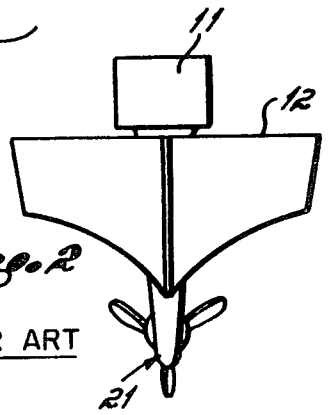
FIG. 2 is a diagrammatic front view of the boat, motor and mounting arrangement of FIG. 1.

While the invention is susceptible to various modifications and alternative forms, certain illustrative embodiments have been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With initial reference to FIG. 1, an outboard motor 11 is conventionally mounted to a boat 12 by a mounting plate structure 13. The mounting plate 13 is rigidly attached to the stern of the boat 12 and to an outer steering tube 14. The motor 11 is rotatably received by the steering tube 14 for rotation about the steering axis 15. In order to rotate the motor 11 about the axis 15 to steer the boat, a steering arm 16 is rotated by a steering cable (not shown) under the control of an operator of the boat 12.

The axis of rotation 15 passes slightly forward of the hydrodynamic center of pressure 17 in accordance with the above described conventional practice. The steering axis 15 lies forwardly of the drive shaft 18 which drives the motor propeller 19. The gearing between the drive shaft 18 and the propeller 19 is contained in the lower gear case housing 21 of the motor 11. The steering axis 15 also lies forwardly of the center of mass 22 of the motor 11.

In order to improve the stability of this conventional design, it is necessary to place the center of mass 22 of the outboard motor 11 on, or preferably forward of, the steering axis 15. It is undesirable to accomplish this by adding significant weight to the forward portion of the motor 11 since adding the amount of weight to effectively move the center of mass would be intolerable from a performance standpoint.

It is also impossible to relocate the steering tube 14 to a position in which the center of mass 22 lies forwardly of the steering axis 15 due to the presence of the drive shaft 18 in the motor housing. Additionally, there are other obstructions in the housing, in the general area beneath the center of mass 22, such as exhaust and cooling water lines. Therefore, moving the steering tube 14 would require a very significant redesign of a conventional motor 11.

Figure 3:
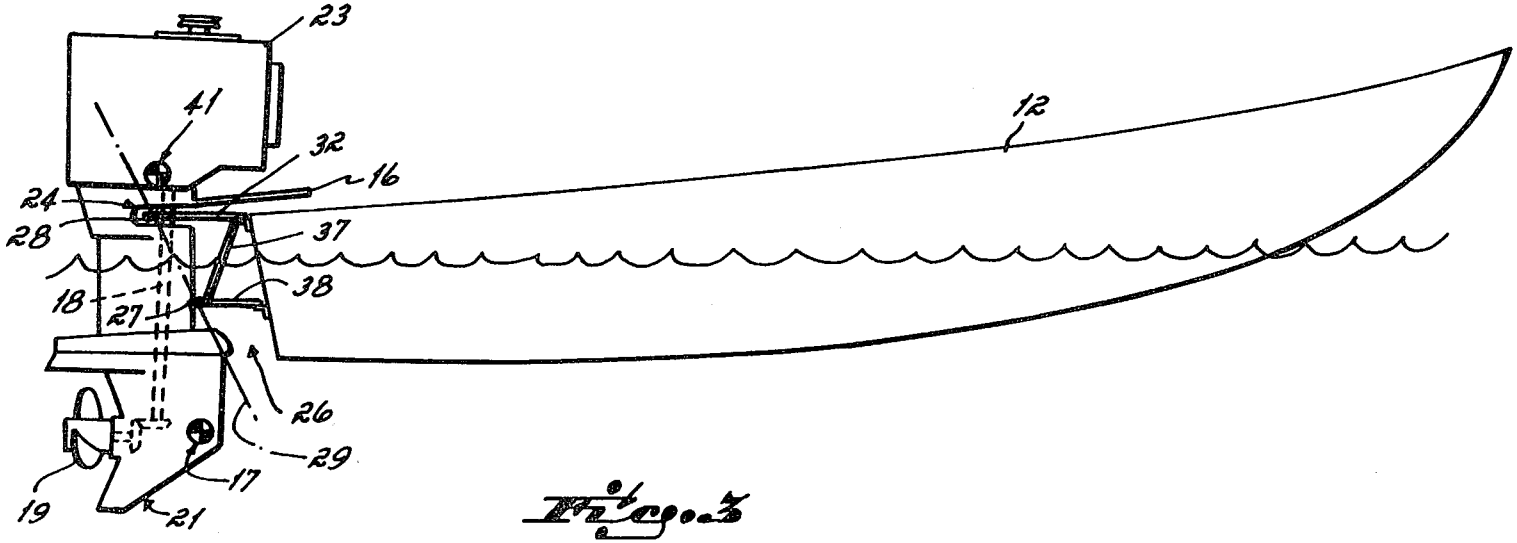
FIG. 3 is a side view of a boat, motor and mounting arrangement in accordance with an aspect of the present invention.
Figure 4:
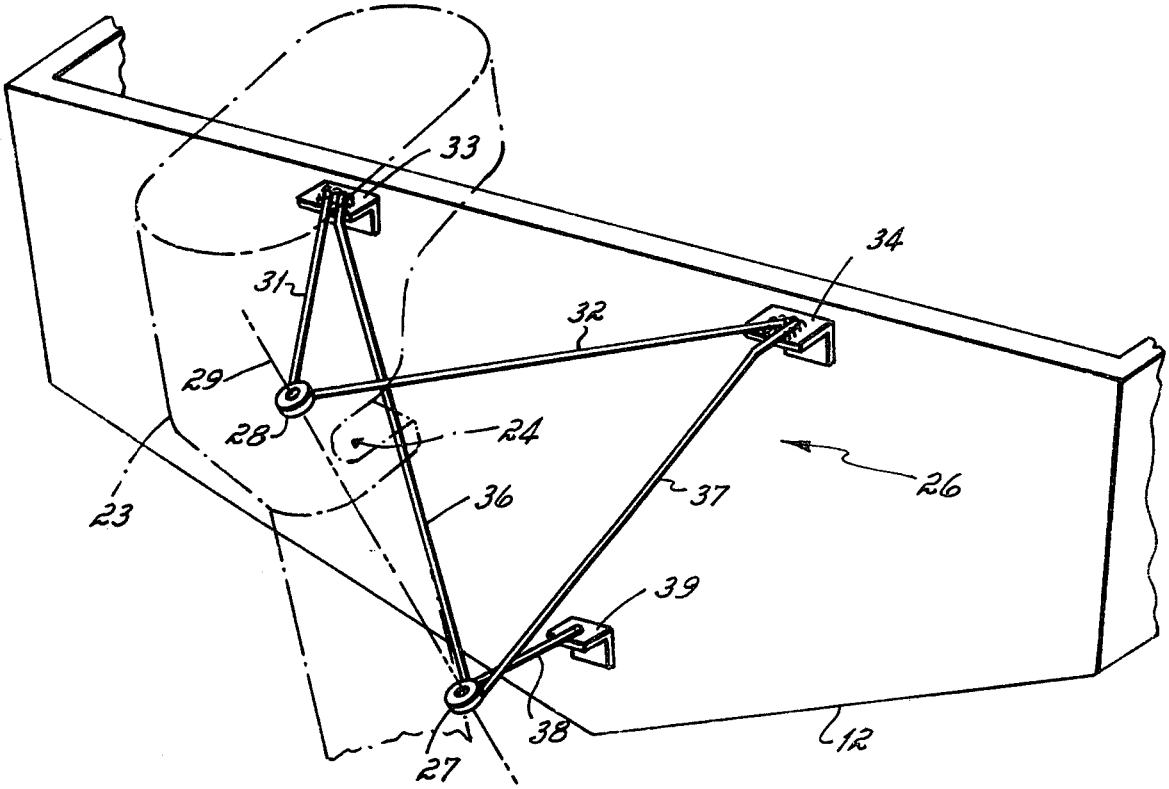
FIG. 4 is a perspective view of the mounting arrangement of FIG. 3.

With reference now to FIGS. 3 and 4, an improved mounting and steering arrangement for an outboard motor 23 on a boat 12 is illustrated. The motor 23 is slightly modified relative to the motor 11, partly by the elimination of the mounting bracket 13 and steering tube 14. In addition a recess 24 is provided to receive a portion of an improved mounting and steering support structure, indicated generally as 26. The support structure 26 includes a lower collar 27 and an upper collar 28 rotatably receiving the motor 23 to define a steering axis 29.

In the support structure 26, upper support links 31 and 32 are rigidly attached to the collar 28 and extend to respective brackets 33 and 34, to which they are rigidly attached such as by welding. Also welded to the brackets 33 and 34 are lower support links 36 and 37, respectively, which extend to the lower collar 27 to which they are rigidly attached. A fifth link 38 serves as a strut for the lower portion of the support structure 26 and is rigidly attached at one end to the lower collar 27 and at its other end to a third bracket 39. The brackets 33, 34 and 39 are bolted or otherwise secured to the stern of the boat 12.

The axis of rotation 29 defined by the rotatable mounting of the motor 23 on the support structure 26 passes above and forwardly of the hydrodynamic center of pressure 17 on the lower gear case housing 21. Such location of the steering axis 29 is an improvement over conventional techniques for moving the hydrodynamic pressure center rearwardly through various motor design modifications. This is because the dimensions of the support structure 26 can be manipulated to locate the steering axis 29 in a more clearly advantageous position relative to the pressure center 17 than can be accomplished readily by design changes to the motor.

The steering axis 29 also is located by the support structure 26 to pass below and behind the center of mass 41 of the motor 23. This is accomplished without adding mass to the motor, without interposing a steering tube at a disadvantageous position in the lower motor housing, and without requiring a substantial redesign of the motor. A modification to a conventional motor is, however, required in order to provide the recess 24 to accommodate the upper collar 28 of the support structure 26. Typically, the steering axis 29 is angled upwardly and rearwardly, and provided at about a 15° to 20° angle with vertical.

Figure 5:
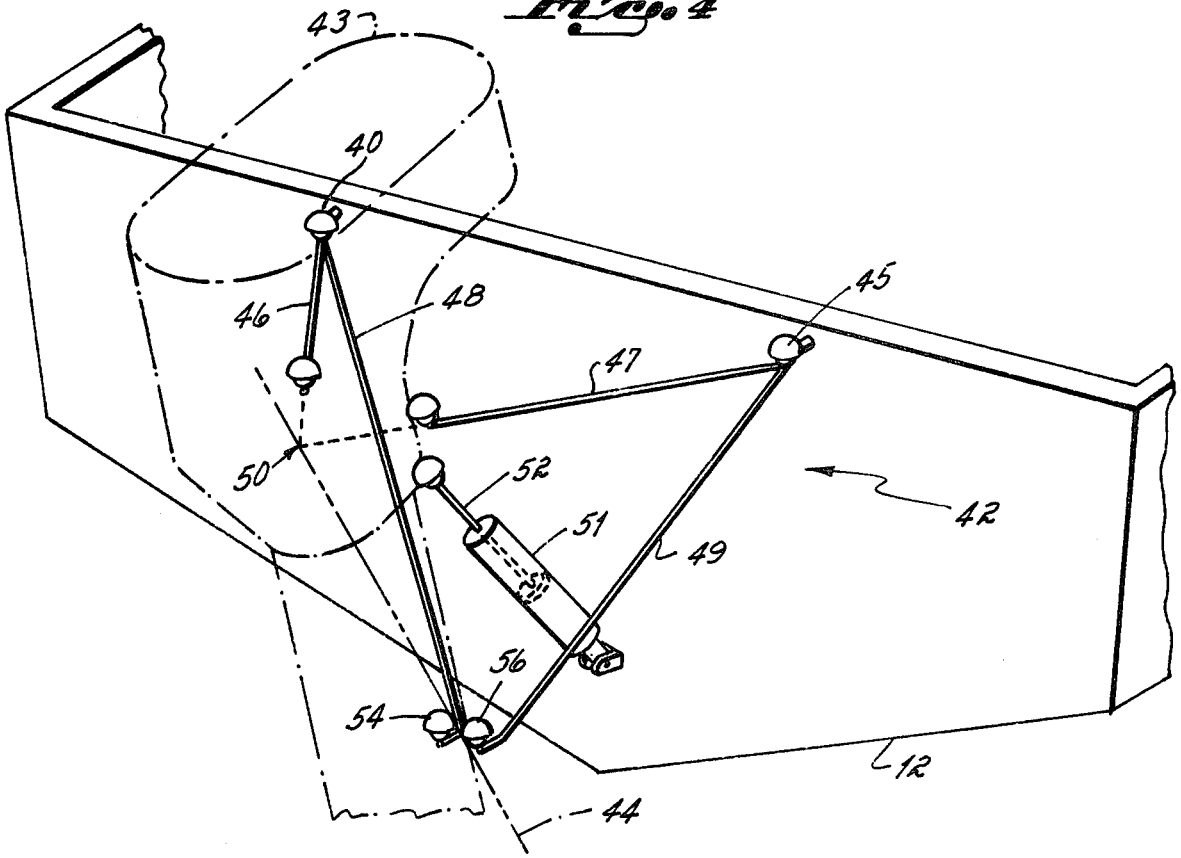
FIG. 5 is a perspective view of an alternative embodiment of the present invention.

Further in accordance with the present invention, and in order to avoid modifications to a conventional outboard motor, in FIG. 5 there is illustrated another support structure 42 in an arrangement for steerably mounting an outboard motor 33 on the boat 12. In this arrangement a steering axis 44 is defined which varies slightly instantaneously with the rotation of the motor 43 as the boat is steered. The steering axis 44 is in all cases substantially oriented in the same fashion as the steering axis 29 in FIG. 3. The support structure 42 is comprised of a pair of upper links 46 and 47 and a pair of lower links 48 and 49. The support strut of the previous support structure is replaced by a hydraulic cylinder arrangement 51, the function of which shall be described hereinafter.

In the support structure 42, the upper links 46 and 47 do not meet at a support collar at the motor 43 but instead are mounted in respective ball joint connectors on either side of the housing of the motor 43. Likewise, the opposite ends of the upper links 46 and 47 are coupled to the boat 12 through ball joint couplings 40 and 45, respectively. In this manner, when the motor 43 is rotated, such as through the actuation of a steering arm (not shown), the links 46 and 47 not only permit rotation of the motor 43, but also provide a limited degree of translation of the motor. That is, the steering axis 44 is permitted to swing through a small flat arc as the motor is rotated for steering. Through the use of this coupling arrangement, the links 46 and 47 are attached on opposite sides of the housing of a conventional motor while defining a virtual rotation point 50 interior of the motor housing. The virtual point of rotation at any given position of the motor 43 is determined by the intersection of extensions of lines coincident with the links 46 and 47.

The lower links 48 and 49 are also attached to the boat 12 by the ball joint couplings 40 and 45, and to the housing of the motor 43 by ball joint couplings 54 and 56. In the illustrated form of the support structure, the lower ends of the links 48 and 49 terminate in separate ball joints so that there is a small amount of translation of the lower end of the steering axis 44 as well as of the upper end.

In order to provide the axis tilting capability of a conventional outboard motor mounting arrangement, a hydraulic cylinder 51 is provided to serve as a strut between the housing of the motor 43 and the boat 12. The cylinder 51 is hydraulically actuated by the operator of the boat 12 to adjust the positioning of the rod 52 and hence, the angle of the steering axis 44. Such a hydraulic tilt/trim cylinder is used to raise the outboard motor propeller portion such as in shallow water or on land, and it is used when the boat is moving to trim the planing angle of the boat. A tilt/trim cylinder may also be used in conjunction with the support structure 26 of FIGS. 3 and 4. In order to do this the strut 38 is replaced by a hydraulic cylinder arrangement attached in generally the same manner as the cylinder 51. In addition the brackets 33 and 34 must be replaced by suitable pivotable attachments.

In employing the inventive mounting and steering arrangements described herein, it is preferable to utilize a steering cable arrangement with the outboard motor steering arm which provides more than the usual amount of steering cable compliance. This is in order to take advantage of the stabilizing effect of the relocation of the steering axis relative to the center of mass of the motor rather than to overly constrain the movement of the motor.

In the illustrated constructions certain specific mounting and structural forms have been shown, but they may be modified as necessary to provide requisite strength, durability or other advantages in specific designs. For example, elastomeric materials may be utilized in the links or joints illustrated to eliminate the need for conventional bearings, seals and lubricants, and for isolating motor vibrations from the boat.

I claim:

1. A support structure for the steerable mounting of an outboard motor on a boat comprising a framework having at least three locations in a mounting area which incorporate means for attaching the framework to a boat, means for pivotally attaching a motor to the framework at a first point spaced apart from said mounting area a first distance by a lower strut portion of the framework, and means for pivotally attaching a motor to the framework at a second point spaced apart a second distance, greater than said first distance, from said mounting area, said second point being above said first point, the two attachment means defining at least one axis of rotation for the motor which slants at an angle greater than 10° from a vertical plane passing through one of said three points in moving from said first attachment point to said second attachment point along the axis of rotation, when the motor drive shaft is substantially vertical.

2. An outboard motor and boat arrangement comprising a boat, an outboard motor, and a support structure for the steerable mounting of the outboard motor on the boat including a framework having at least three locations in a mounting area which incorporate means for attaching the framework to the boat, means for pivotally attaching the motor to the framework at a first point spaced apart from said mounting area a first distance by a lower strut portion of the framework, and means for pivotally attaching the motor to the framework at a second point spaced apart a second distance, greater than said first distance, from said mounting area, said second point being above said first point, the two attachment means defining at least one axis of rotation for the motor which slants at an angle greater than 10° from a vertical plane passing through one of said three points in moving from said first attachment point to said second attachment point along the axis of rotation, when the motor drive shaft is substantially vertical.

3. A mounting arrangement for an outboard motor on a boat comprising an outboard motor having an upper portion and having a generally elongated lower portion including a substantially vertical drive shaft in a lower housing, and a support structure operable to be attached to a boat and including means for pivotally attaching the support structure to the lower housing at a first point forward of the drive shaft to establish one steering axis location, and means for pivotally attaching the support structure to the motor housing at a second point, above said first point, and rearwardly of the drive shaft to establish a second steering axis location, to define a steering axis for the outboard motor angled relative to the drive shaft of the motor.

4. The mounting arrangement of claim 3 which further comprises a boat attached to said support structure.

5. A support structure for steerably mounting an outboard motor on a boat comprising a lower support strut portion for pivotally attaching an outboard motor to a boat, and an upper linkage portion including a pair of links in a common plane each positioned to be disposed on opposite sides of an outboard motor when it is attached to a boat, each link being operable to be pivotally attached at an end to a boat and extending toward one another to define a virtual intersection point, with each link terminating short of such point in a fashion to be pivotally attached to an outboard motor on opposite sides thereof, the virtual intersection point lying along an inclined axis of rotation for an outboard motor.

6. A mounting arrangement for an outboard motor on a boat comprising an outboard motor and a support structure for steerably mounting the outboard motor on a boat comprising a lower support strut portion for pivotally attaching the outboard motor to a boat, and an upper linkage portion including a pair of links in a common plane each positioned to be disposed on opposite sides of the outboard motor when it is attached to a boat, each link being operable to be pivotally attached at an end to a boat and extending toward one another to define a virtual intersection point, with each link terminating short of such point in a fashion to be pivotally attached to the outboard motor on opposite sides thereof, the virtual intersection point lying along an inclined axis of rotation for the outboard motor.

7. A support structure for steerably mounting an outboard motor on a boat comprising means for attaching the support structure to a boat, means for pivotally attaching a lower portion of an outboard motor to the support structure, and means for attaching the support structure to an upper portion of an outboard motor with at least two movable portions of the support structure which, together with the means for pivotally attaching a lower portion of the outboard motor, constrain the outboard motor to rotate about a variable instantaneous steering axis which changes position as the outboard motor is rotated for steering on the support structure.

8. A mounting arrangement for an outboard motor on a boat comprising an outboard motor and a support structure for steerably mounting the outboard motor on a boat comprising means for attaching the support structure to a boat, means for pivotally attaching a lower portion of the outboard motor to the support structure, and means for attaching the support structure to an upper portion of the outboard motor with at least two movable portions of the support structure which, together with the means for pivotally attaching a lower potion of the outboard motor, constrain the outboard motor to rotate about a variable instantaneous steering axis which changes position as the outboard motor is rotated for steering on the support structure.

9. An outboard motor and boat arrangement comprising a boat, an outboard motor, and a support structure for steerably mounting the outboard motor on the boat comprising means for attaching the support structure to the boat, means for pivotally attaching a lower portion of the outboard motor to the support structure, and means for attaching the support structure to an upper portion of the outboard motor with at least two movable portions of the support structure which, together with the means for pivotally attaching a lower portion of the outboard motor, constrain the outboard motor to rotate about a variable instantaneous steering axis which changes position as the outboard motor is rotated for steering on the support structure.

10. A mounting arrangement for an outboard motor on a boat comprising an outboard motor, having an upper portion and having a generally elongated lower portion including a substantially vertical drive shaft, and a support structure having means for attaching the support structure to a boat and means for pivotally attaching the outboard motor to the support structure for steering rotation of the motor about a steering axis which is angled upwardly and rearwardly and passes through or behind the center of gravity of the outboard motor.

11. A boat and outboard motor arrangement comprising a boat, an outboard motor, having an upper portion and having a generally elongated lower portion including a substantially vertical drive shaft, and a support structure having means for attaching the support structure to the boat and means for pivotally attaching the outboard motor to the support structure for steering rotation of the motor about a steering axis which is angled upwardly and rearwardly and passes through or behind the center of gravity of the outboard motor.

* * * * *

UNITED STATES PATENT AND TRADEMARK OFFICE

CERTIFICATE OF CORRECTION

PATENT NO. : 4,482,332

DATED : November 13, 1984

INVENTOR(S) : J. Bruce Emmons

It is certified that error appears in the above-identified patent and that said Letters Patent is hereby corrected as shown below:

In column 6, line 13, "potion" should be --portion--.

Signed and Sealed this

*Ninth* Day of *April 1985*

[SEAL]

*Attest:*

DONALD J. QUIGG

*Attesting Officer*

*Acting Commissioner of Patents and Trademarks*